US006035442A

United States Patent [19]

Marando

[11] Patent Number: 6,035,442

[45] Date of Patent: Mar. 14, 2000

[54] SPORTS GLOVE FOR ARTHRITIS

[76] Inventor: Don Marando, 13-3315 Makama St., Pahoa, Hi. 96778

[21] Appl. No.: 08/934,314

[22] Filed: Sep. 19, 1997

[51] Int. Cl.[7] ..... A41D 19/00

[52] U.S. Cl. ..... 2/161.1; 2/161.2; 2/20

[58] Field of Search ..... 2/161.1, 161.2, 2/161.3, 161.4, 161.5, 159, 162, 163, 16, 20, 158, 160, 161.6; 473/205; 482/49

[56] References Cited

U.S. PATENT DOCUMENTS

| | | | |
|---|---|---|---|
| Re. 31,538 | 3/1984 | Antonious | 2/161 |
| 2,852,779 | 9/1958 | Roessler | 2/161.2 |
| 2,907,046 | 10/1959 | Scherr | 2/159 |
| 3,105,972 | 10/1963 | Christopher | 2/161.2 |
| 3,274,616 | 9/1966 | Russo | 2/161.3 |
| 3,348,238 | 10/1967 | Hydock | 2/161.2 |
| 3,649,967 | 3/1972 | Millman | 2/161.3 |
| 4,329,741 | 5/1982 | Bach | 2/161 |
| 4,658,445 | 4/1987 | Tribble | 2/161 |
| 4,781,178 | 11/1988 | Gorden | 128/77 |
| 5,022,094 | 6/1991 | Hames et al. | 2/163 |
| 5,117,509 | 6/1992 | Bowers | 2/161.1 |
| 5,156,399 | 10/1992 | Gauer | 273/187.2 |
| 5,177,881 | 1/1993 | Moore | 34/239 |
| 5,369,807 | 12/1994 | Cho et al. | 2/159 |
| 5,414,868 | 5/1995 | Crawford | 2/160 |
| 5,423,089 | 6/1995 | Chun et al. | 2/161.2 |
| 5,459,883 | 10/1995 | Garceau-Verbeck | 2/161.1 |
| 5,517,694 | 5/1996 | Fabry | 2/161.1 |
| 5,553,324 | 9/1996 | Emerson | 2/158 |
| 5,634,214 | 6/1997 | St. Ville | 2/161.2 |
| 5,673,437 | 10/1997 | Chase et al. | 2/20 |
| 5,809,570 | 9/1998 | Grover | 2/161.1 |
| 5,845,374 | 12/1998 | Briggs | 2/161.2 |

*Primary Examiner*—Amy Vanatta

[57] ABSTRACT

The present invention is a sports glove for arthritis having a thick padding securely attached to the palm and fingers. The padding functions to increase the relative diameter of an item grasped in the hand of the user. This permits the same grip to be retained on an item with less flexing of the fingers. Primarily the present invention is used by individuals experiencing pain when flexing the fingers to grip an item. A strap is provided which functions to securely and removably attached the user's hand to a sports club.

3 Claims, 2 Drawing Sheets

SPORTS GLOVE FOR ARTHRITIS

BACKGROUND OF THE INVENTION

1. Field of the Invention

The present invention relates to sports equipment. More particularly, the present invention relates to a sports glove for use with people having a joint ailment preventing a proper grip on a sports club. Further, the present invention assists a person, lacking strength in their hands, to maintain a grip on the sports club.

2. Description of the Prior Art

Many people afflicted with an ailment or length of proper grip strength have difficulty grasping a sports club firmly enough to assure a proper swing, contact and follow through when hitting a sports object such as a ball. This especially affects people having arthritis, rheumatism and other crippling diseases of the hands and joints. Certain diseases cause the individual pain when the joints of the hand are flexed beyond a certain point, yet prior to that point the pains is bearable. A solution is to increase the diameter of the handle of the sports club. However, typical this is done in a permanent fashion resulting in the sports club being dedicated to one individual. Custom sports clubs with an enlarged grip are very expensive and can effect the performance of the club.

A second problem with people having a joint deceases is that often their grip is inadvertently relaxed in the back swing. Often this is an affliction in the elderly resulting in the embarrassing loss of the sports club.

What is needed is a device which provides a painless grip and has a secure attachment of the user's hand to a sports club.

Numerous innovations for sports glove for arthritis have been provided in the prior art that are described as follows. Even though these innovations may be suitable for the specific individual purposes to which they address, they differ from the present invention as hereinafter contrasted.

In U.S. Pat. No. 5,634,214, titled Golf Glove and Golf Gripping Method, invented by James A. St. Ville, the present invention is a golf glove which includes padding to assist in properly gripping a golf club and to also protect the hand when playing golf. The glove further includes a visual indicator to assist in properly gripping a golf glove. The glove also incorporates transversely isotropic material in a portion of the glove to assist in a proper fit. The invention also includes a method of gripping a golf club to assure proper grip and grip alignment.

The patented invention differs from the present invention because the patented invention is a padding like device which functions to guide a golf club handle into a proper position in the user's hand. The patented invention is positioned across the outer extend of the palm of a glove. In the present invention a thick padding securely attached to the palm and fingers. The thick padding functions to increase the relative diameter of an item grasped such as a golf club. The padding permits the same grip to be retained on an item with less flexing of the fingers which reduces pain associated with finger flexing in certain diseases.

In U.S. Pat. No. 5,423,089, titled Golf Glove, invented by Yung Yul Chun and Hae K. Joh, a three-fingered golf glove, comprising a middle finger portion, a ring finger portion, and a little finger portion, which has the curvatures of the fingers fully gripping a golf club handle, leaving the thumb and the index finger uncovered; a plurality of fourchettes having external edges; each external edge comprising three segments of straight lines connected by two small joint curved arcs; a curved end side piece having the shape of the lower side of a hand fully gripping a golf club handle; the finger portions, when assembled, having trapezoidal cross-sections; a palm tautening strap being fastened to connect the palm side finger portions and the rear side finger portions while the hand is in a shape fully gripping a golf club handle, forming a loop of tensile force perpendicular to the club axis to completely eliminate bunching and wrinkling at the entire palm section of the glove; a thumb strap forming a force line at the palm portion in the direction parallel to the club axis; reinforcing threads stitched to the palm portion and the palm side and rear side finger portions to strengthen the glove material against being stretched permanently when wet; one or a plurality of thin and flexible friction strips sewn to the palm portion, the sharp corrugations thereon being parallel to the club axis, to maintain the increased anti-twist resistance of the glove, even when the glove is fully wet with rain or perspiration.

The patented invention differs from the present invention because the patented invention is a three-fingered golf glove. The three fingers are prebent to the general shape of a golf club grip. The first finger and the thumb are not covered by the glove. In the present invention a thick padding securely attached to the palm and fingers. The entire hand is covered by the glove. The thick padding functions to increase the relative diameter of an item grasped such as a golf club.

In U.S. Pat. No. 5,414,868, titled Golf Glove with Grip-Maintaining Straps, invented by Jerry G. Crawford, an improved golf glove for assisting a golfer having a muscular impairment in maintaining the golfer's hand in proper gripping position about a golf club handle includes a pair of elongate straps fixed to the glove body at opposite sides of the thumb extension, each strap having a fastener portion along its outwardly extending length, and a mating fastener arrangement at the backhand side of the glove body, including selected locations on the finger and thumb extensions, for securement of the straps when the golfer grips the club handle, thereby to retain the golfer's thumb and fingers in proper gripping disposition during swinging of the club.

The patented invention differs from the present invention because the patented invention is an improved golf glove for assisting a golfer having a muscular impairment. The patented invention comprises fastening strips functioning to hold the fingers of the user in place on the club. The patented invention lacks padding on the palm or fingers.

In U.S. Pat. No. 5,369,807, titled Therapeutic Glove, invented by Kurt N. Cho and Chae H. Cho, a therapeutic glove that may be used to provide pressure and heat to relieve pain caused from arthritis or other ailments in a user's hand. The glove utilizes a heat retaining gel that may be warmed with hot water and the like to provide therapeutic heat to the hand of a user over a period of time. To provide for further therapy, the glove includes a small air pump that may be used to inject air into the glove to provide pain relieving pressure on the user's hand.

The patented invention lacks features similar to the present invention.

In U.S. Pat. No. 5,177,881, titled Golf Accessory for use with a Golf Bag for Drying a Golf Glove and Displaying the Logo of a Golf Course or Event, invented by Joseph A Moore, a golfing accessory capable of being attached to the exterior of a golf bag includes a plate-like portion providing space for the name of the golfer and the logo of a particular golf course or golfing event. The plate-like element is attached to a first strap attached to the bag. A second strap hangs from the plate-like portion and contains a fastener thereon for detachably securing a golf glove for the purpose of drying the glove. A hook may also be provided on the first strap for hanging a golfing towel.

The patented invention differs from the present invention because the patented invention is a golfing accessory capable of being attached to the exterior of a golf bag. The patented invention lacks features similar to the present invention.

In U.S. Pat. No. 5,156,399, titled Golf Glove-Supported Golf Swing Aid, invented by Robert Gauer, a golf swing and grip aid that extends from between the rear flaps of a golf glove in the view of the golfer while addressing the golf ball, that advantageously uses the coacting hook and loop fastener patches of the glove to achieve its attached relation to cooperating loop and hook fastener patches provided on the body of the aid.

The patented invention differs from the present invention because the patented invention is a golf swing and grip aid. The patented invention lacks features similar to the present invention.

In U.S. Pat. No. 4,781,178, titled Orthopedic Glove, invented by Kevin M. Gordon, an orthopedic glove is described, to which one or more splints are affixed at selective locations to immobilize a joint of a particular finger and/or the wrist of the hand, while not significantly interfering with the movement of the associated metacarpal joint. This selective affixing of one or more splints to the orthopedic glove allows for the immobilization of only those joints which are afflicted by arthritis. The glove may further include independently adjustable straps which can be secured about various portions of the glove.

The patented invention differs from the present invention because the patented invention is an orthopedic glove. The patented invention lacks features similar to the present invention.

In U.S. Pat. No. 4,658,445, titled Golf Glove, invented by Robert L. Tribble, a golf glove including a tensioning strap that will cause the thumb of the wearer's hand to be pulled in a relatively straight upward motion toward the wrist, from a point just above the first joint nearest to the end of the thumb, to and including the second joint or knuckle, while at the same time causing the end of the thumb to be pulled in a backward and upward motion toward the wrist, while restricting this backward and upward motion from the first joint nearest the end of the thumb, to and including the end of the thumb.

The patented invention differs from the present invention because the patented invention is a tensioning strap that will cause the thumb of the wearer's hand to be pulled in a relatively straight upward motion toward the wrist. The patented invention lacks features similar to the present invention.

In U.S. Pat. No. Re. 31,538, titled Golf Glove, invented by Anthony J. Antonious, a golf glove that provides a taut fit on the wearer's palm and fingers by providing elastic means across the knuckle area of the glove that cooperate with a fastener. A deep vent portion in glove opening can be provided on the back portion to permit easy entry of the hand. The glove can be adjustably fastened upon the hand by one or more Velcro nylon tabs which can be directly attached to one side of the deep vent portion of glove opening or can be attached through a ring with a flexible strap to provide a double closure. The palm portion of the glove can be provided with a reinforced pad and vent perforations. An additional pad can be extended between the webbing of the thumb and index fingers to ensure protection for other sports. A ball marker can be locked into the Velcro tab fastener or separately attached to the glove.

The patented invention differs from the present invention because the patented invention is a golf glove that provides a taut fit on the wearer's palm and fingers by providing elastic means across the knuckle area. The patented invention lacks features similar to the present invention.

In U.S. Pat. No. 4,329,741, titled Golf Glove, invented by Merlyn F. Bach, a golf glove having a palm portion, a wrist portion adjacent one end of the palm portion and a finger portion on an opposite end of the palm portion includes a first elongated pad secured to the palm portion and extended diagonally there across at a position adjacent to the finger portion and at an angle with respect to the finger portion. A second elongated pad is secured to the palm portion and extended diagonally there across in parallel spaced relationship to the first elongated pad so as to create a diagonally disposed valley portion between the first and second elongated pads to receive the handle of a golf club therein.

The patented invention differs from the present invention because the patented invention is a padding like device which functions to guide a golf club handle into a proper position in the user's hand. The patented invention is positioned across the palm of a glove ending at the knuckle area. In the present invention a thick padding securely attached to the palm and fingers. The thick padding functions to increase the relative diameter of an item grasped such as a golf club. The padding permits the same grip to be retained on an item with less flexing of the fingers which reduces pain associated with finger flexing in certain diseases.

The above patented inventions differ from the present invention because they fail to describe or claim at least one combination of the following features depicted in the present invention padding covering the entire palm which functions to decrease the flexing of the fingers and a strap which functions to securely and removably attach the user's hand to a sports club.

Numerous innovations for sports glove for arthritis have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a sports glove for arthritis having a thick padding securely attached to the palm and fingers. The padding functions to increase the relative diameter of an item grasped in the hand of the user. This permits the same grip to be retained on an item with less flexing of the fingers. Primarily the present invention is used by individuals experiencing pain when flexing the fingers to grip an item. A strap is provided which functions to securely and removably attached the user's hand to a sports club.

The types of problems encountered in the prior art are people with weak grips and experiencing pain from a disease have difficulty consistently providing a firm grip on a sports club.

In the prior art, unsuccessful attempts to solve this problem were attempted namely various forms of palm padding and straps attached to sports gloves and increasing the diameter of the grip on a sports club. However, the problem was solved by the present invention because padding is applied to the entire surface of the glove functioning to increase the effective diameter of a grip. Further, a strap is provided to assist in maintaining a grip on a sports club during the back swing when there is a inadvertent tendency to loosen ones grip.

The present invention went contrary to the teaching of the art by covering the entire hand with a thick padding, and providing a strap which is positioned to removably and securely fasten the wrapped fingers within the glove around the sports club grip.

The present invention solved a long felt need for a device that permits persons afflicted with arthritic diseases to continue to play sports that require gripping a sports club.

Accordingly, it is an object of the present invention to provide a less painful grip on a sports club by a thick padding extending over the inner surface of a sports glove.

More particularly, it is an object of the present invention to provide A sports glove with a strap and padding.

In keeping with these objects, and with others which will become apparent hereinafter, one feature of the present invention resides, briefly stated, in a spots glove having fingers and a thumb.

When the sports glove for arthritis is designed in accordance with the present invention, people with weak grips and experiencing pain from a disease can consistently provide a firm grip on a sports club.

In accordance with another feature of the present invention, a plurality pads are placed on the finger tips, inner finger, inside knuckles, thumb end and inner palm.

Another feature of the present invention is that a pad is placed over the entire inner palm area.

Yet another feature of the present invention is that a strap is positioned to wrap around the base of the thumb and hold the two middle fingers and little finger to the sports club. The strap may be wrapped in either direction around the sports club and the fingers of the hand.

Still another feature of the present invention is that elongated pads are positioned at the fingers, palm, thumb and inner palm.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

Third Embodiment

310—third sports glove for arthritis (310)

314—third pad (314)

DESCRIPTION OF THE PREFERRED EMBODIMENT

Figure 1:
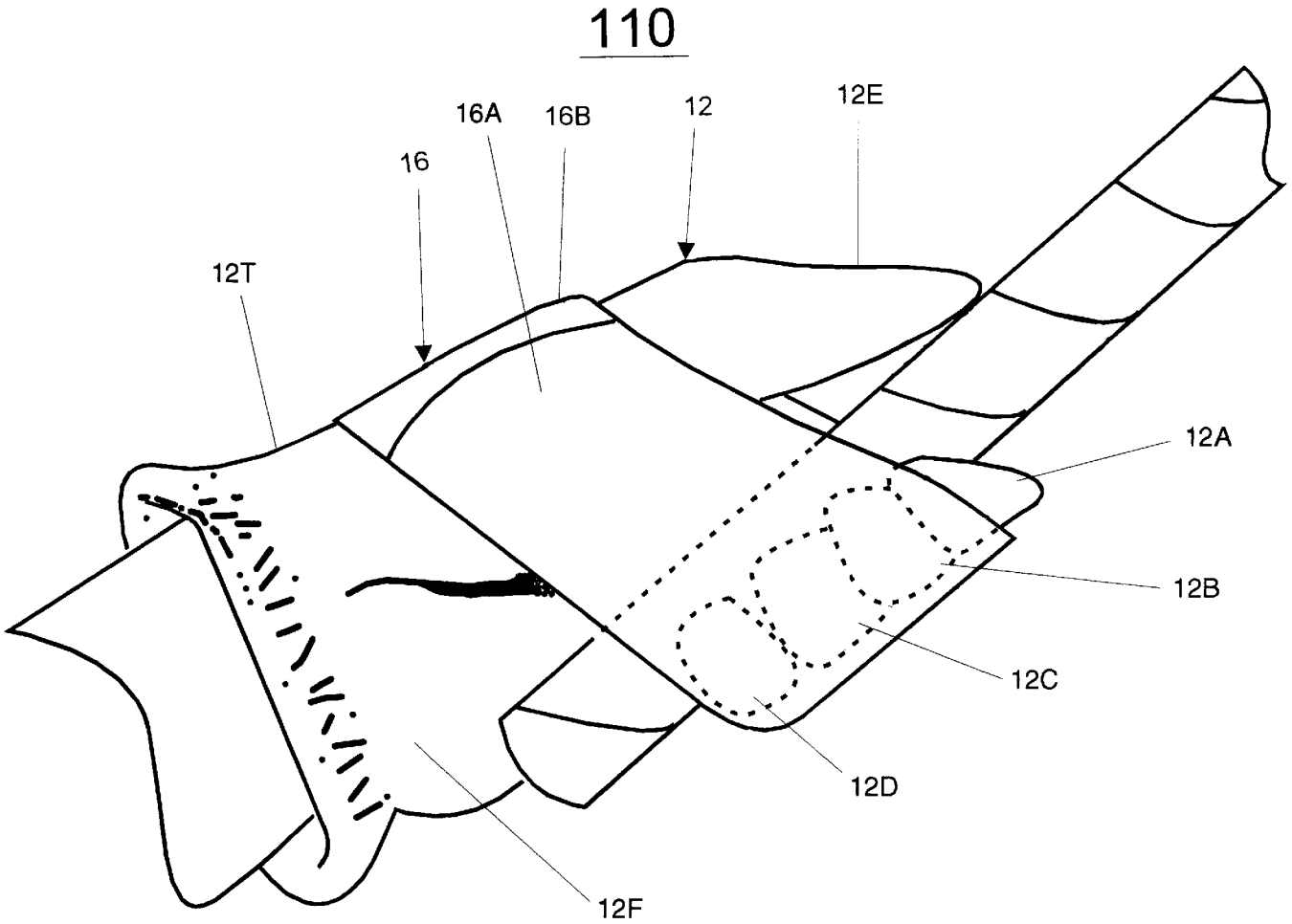
FIG. 1 is a left side perspective view of a first sports glove for arthritis on an arthritic user's hand holding a sports racket or club exhibiting the strap wrapped around the user's fingers.

Firstly, referring to FIG. 1 which is a left side perspective view of a sports glove for arthritis on an arthritic user's hand holding a sports racket or club exhibiting the strap (16) wrapped around the user's fingers (12A, 12B, 12C, 12D). The first sports glove for arthritis (110) comprises a glove (12) which comprises a glove index finger (12A), a glove middle finger (12B), a glove fourth finger (12C), a glove pinky finger (12D), a glove thumb (12E), a glove bottom (12F), and a glove top (12T). The glove (12) is manufactured from a material selected from a group consisting of leather, plastic, plastic composite, synthetic fibers, natural fibers, rubber and rubber composite.

The sports glove for arthritis further comprises a strap (16) which comprises a first end securely attached to the glove top (12T). The strap (16) further comprises a strap top (16A) having hook dispersed thereon, the strap (16) further comprises a strap bottom (16B) having a second end with loop dispersed thereon. After an arthritic user grips a sports racket or club, the strap (16) is wrapped around over the glove fingers (12A, 12B, 12C, 12D) and the second end with loop is removably fastened to the first end with hook. The strap (16) functions to hold the sports racket or club in an arthritic user's hand during use.

Figure 2:
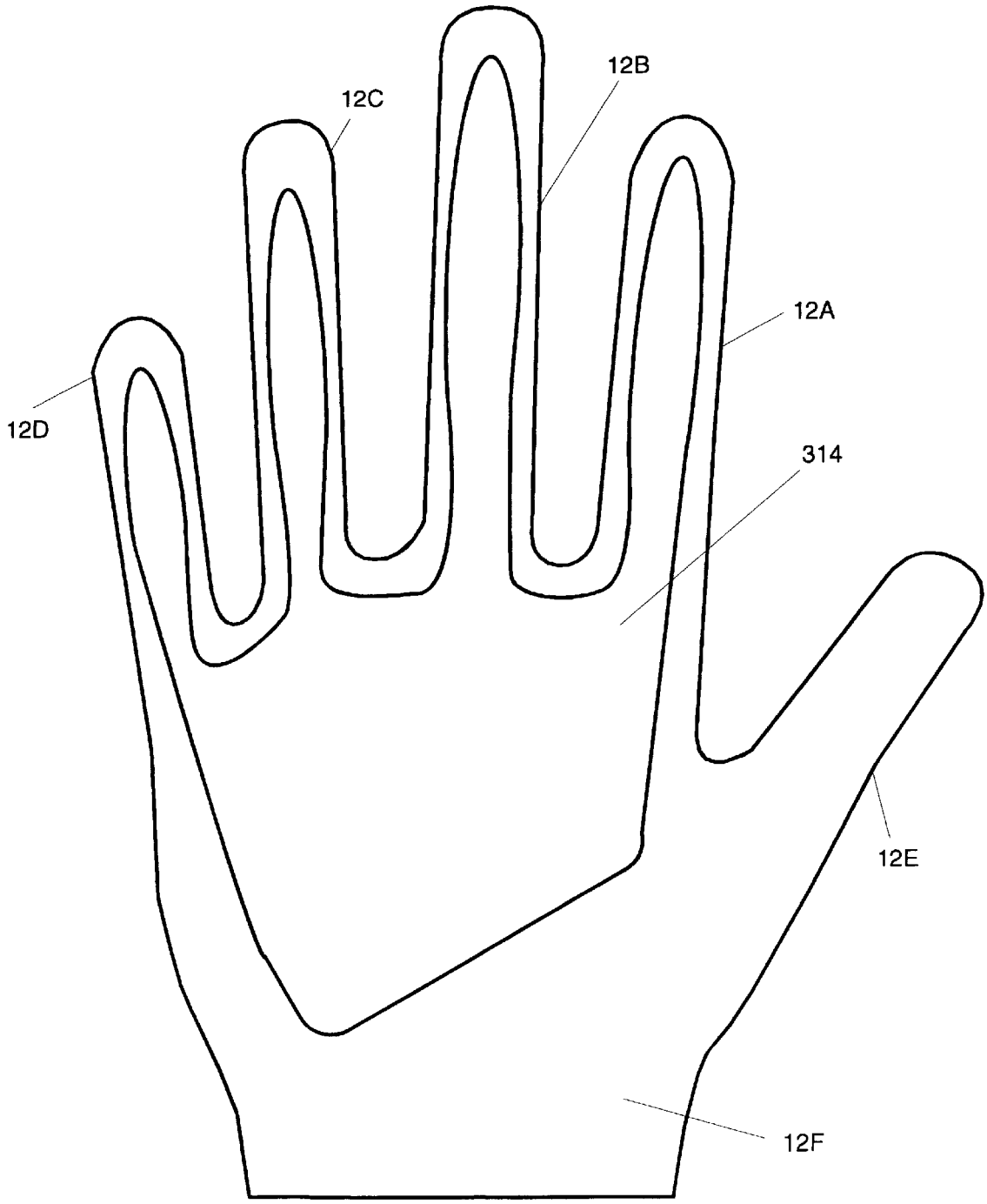
FIG. 2 is a bottom view of a third sports glove for arthritis.

Now referring to FIG. 2 which is a bottom view of a third sports glove for arthritis (310). The third sports glove for arthritis (310) comprises the glove (12) which comprises the glove index finger (12A), the glove middle finger (12B), the glove fourth finger (12C), the glove pinky finger (12D), the glove thumb (12E), the glove bottom (12F), and the glove top (12T).

The third sports glove for arthritis (310) further comprises a third pad (314) securely attached to the glove bottom (12F). The third pad (314) comprises a configuration having a full size palm pad attached to a full length index finger pad, full length middle finger pad, a full length fourth finger pad, and a full length pinky finger pad.

The third pad (314) is manufactured from a material selected from a group consisting of leather, plastic, plastic composite, synthetic fibers, natural fibers, rubber and rubber composite.

It will be understood that each of the elements described above, or two or more together, may also find a useful application in other types of constructions differing from the type described above.

While the invention has been illustrated and described as embodied in a sports glove for arthritis, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A sports glove for arthritis comprising:

A) a glove (12) which comprises a glove index finger (12A), a glove middle finger (12B), a glove fourth finger (12C), a glove pinky finger (12D), a glove thumb (12E), a glove bottom (12F), and a glove top (12T);

B) a strap (16) which comprises a first end securely attached to the glove top (12T), the strap (16) further comprises a strap top (16A) having hooks fully dispersed about a top distal end thereof, the strap (16) further comprises a strap bottom (16B) having a second end with loops fully dispersed about a bottom end thereon after an arthritic user grips a sports racket or club, the strap (16) is wrapped around over the glove fingers (12A, 12B, 12C, 12D) and the second end with the loops is removably fastened to the first end with the hooks, the strap (16) functions to hold the sports racket or club in an arthritic user's hand during use; and C) a unilayer pad (314) securely attached to the glove bottom (12F), the pad (314) comprises a configuration having a full size palm pad attached to a full length index finger pad, a full length middle finger pad, a full length fourth finger pad, and a full length pinky finger pad.

2. The sports glove for arthritis as in claim 1, wherein the glove (12) is manufactured from a material selected from a group consisting of leather, plastic, plastic composite, synthetic fibers, natural fibers, rubber and rubber composite.

3. The sports glove for arthritis as in claim 1, wherein the pad (314) is manufactured from a unilayer material selected from a group consisting of leather, plastic, plastic composite, synthetic fibers, natural fibers, rubber and rubber composite.

* * * * *